US006397642B1

(12) United States Patent
Puigventos

(10) Patent No.: US 6,397,642 B1
(45) Date of Patent: Jun. 4, 2002

(54) AUTOMATIC DEVICE FOR THE SELECTION OF NEEDLES IN A CIRCULAR KNITTING MACHINE FOR KNITTED GOODS

(75) Inventor: Antonio Puigventos, Mataro (ES)

(73) Assignee: Jumberca, S.A., Barcelona (ES)

( * ) Notice: Subject to any disclaimer, the term of this patent is extended or adjusted under 35 U.S.C. 154(b) by 0 days.

(21) Appl. No.: 09/782,223

(22) Filed: Feb. 14, 2001

(30) Foreign Application Priority Data

Feb. 18, 2000 (ES) ..... 200000381

(51) Int. Cl.[7] ..... D04B 15/66
(52) U.S. Cl. ..... 66/216
(58) Field of Search ..... 66/215, 216, 217, 66/218, 219, 220, 221, 222, 223, 224, 225, 226, 227

(56) References Cited

U.S. PATENT DOCUMENTS 3,981,160 A * 9/1976 Balzano et al. ..... 66/223
5,042,275 A * 8/1991 Schick ..... 66/223
5,323,627 A * 6/1994 Lonati et al. ..... 66/215
5,329,790 A * 7/1994 Engelfried et al. ..... 66/223
5,647,230 A * 7/1997 So et al. ..... 66/23
5,960,645 A * 10/1999 Sangiacomo ..... 66/215

* cited by examiner

*Primary Examiner*—Danny Worrell
(74) *Attorney, Agent, or Firm*—Nath & Associates PLLC; Gary M. Nath; Marvin C. Berkowitz

(57) ABSTRACT

Automatic device for needle selection in a circular knitting machine, having at least one needle bed (1) with needles (3) each of which is related to a first jack (8) movable from a position of cancellation of the corresponding needle (3) to a loop position or a clearing position, the said first jack (8) having related to it a second jack (15) with selectable butts (16) which permit the selection of the position of the needle (3), the selectable butts (16) being actuatable by selectors (17) of each knitting position which by automatic means can adopt a first, active position or a second, inactive position.

17 Claims, 13 Drawing Sheets

AUTOMATIC DEVICE FOR THE SELECTION OF NEEDLES IN A CIRCULAR KNITTING MACHINE FOR KNITTED GOODS

The present invention relates to an automatic device for the selection of the needles of a circular machine for knitted goods, which permits the manual selection from the exterior of the machine of the stitches characteristic of cable-stitch machines or there being the possibility of arranging cancellation, loop, or clearing in each position and in a disposition of needles equivalent to the conventional machines with two needle paths, all of this with the added feature of being able to cancel the programming and working of the sections as desired.

There exist many solutions which are applied in circular knitting machines for obtaining different stitches, from the simple machines for plain fabric to the complex solutions employed for electronic needle selection. This is represented by the development of many systems of selection jacks, cam sections, needles, etc., which with more or less success have resulted in machines which are more or less convenient to operate, this being closely related to two factors. The first is that the machine gives few incidents during its operation. The second, equally important, is that the machine is very easy to operate, especially in the preparations which are necessary for arranging pattern changes.

There has always been a divergence between obtaining ease of operation and obtaining a high machine speed. In this way, a considerable increase of machine speed is obtained by the use of interchangeable cams to execute different stitches, since this permits the use of locked cam tracks to make the needle butts follow the path of cancellation, loop, or clearing, in a completely guided manner, which naturally permits high speed operation. The said system is generally arranged with removable and changeable cams, but for the said operation it is necessary to demount the sections of the machine and to effect the substitution of eccentrics in accordance with the desired fabric structure. With the said solution, there are obtained very productive machines which are used for producing large runs of fabric, with infrequent changes of fabric structure.

The present invention endeavors to include another field of fabric production, in which the machine provides great facility of preparation and is arranged to change the stitches contained in given zones of the garment, for which there are arranged automatic mechanisms for cancellation of positions, providing great facility of control, since it is possible to modify the programmed stitches without the necessity of demounting any element of the machine.

With this there is obtained a circular knitting machine which is relatively simplified, with the possibility of being programmed to knit at, or cancel, specified positions of the machine, in combination with a system of automatic stripers which are able to cut the yarn in the cancelled positions and to return it for delivery at the moment when a cancelled position passes to the status of a position which knits. This system can be applied in one of the needle beds and combine it with an electronic needle—needle selection in the second needle bed, or can even be applied to both needle beds.

All of the above makes the prior art machine into a model which is more versatile, with an infinite possibility of stitches.

Figure 13A:
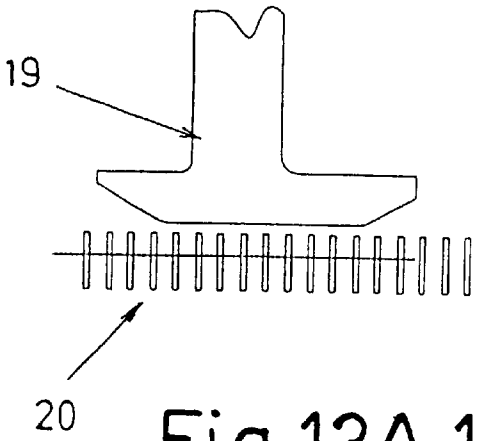
FIGS. 13A, 13B and 13C show a variant of the invention with selectors for jack displacement.
Figure 13A:
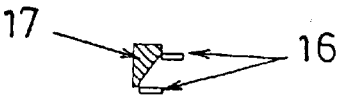
Figure 13A:
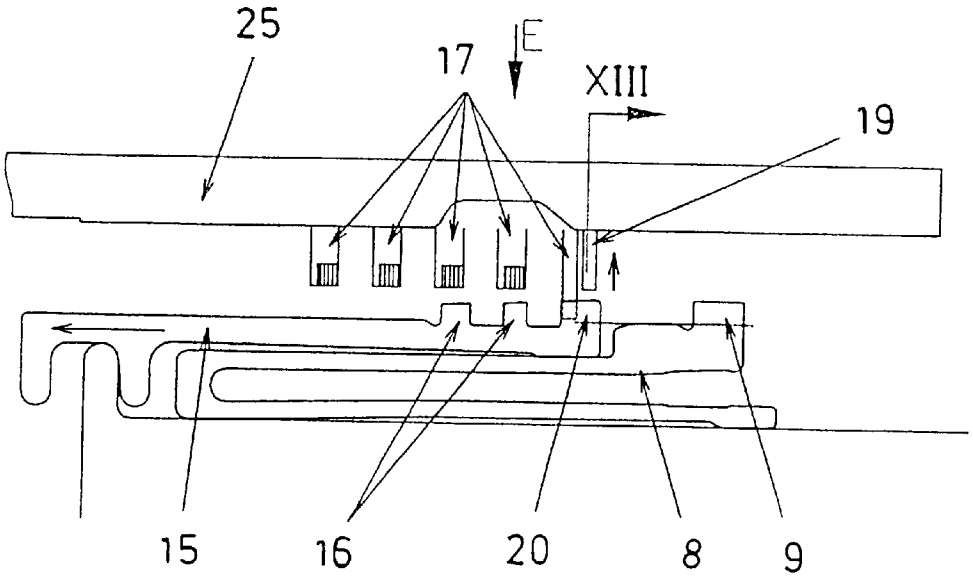
Figure 13B:
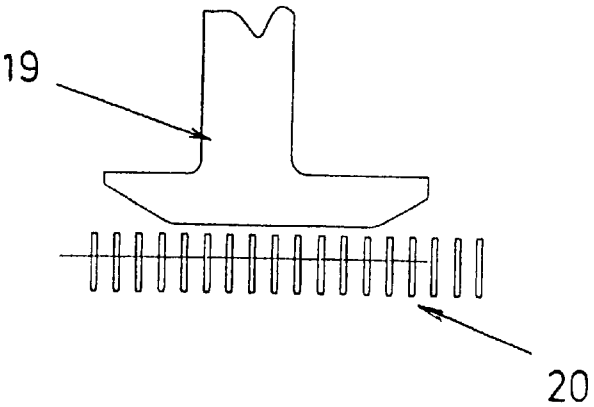
Figure 13B:
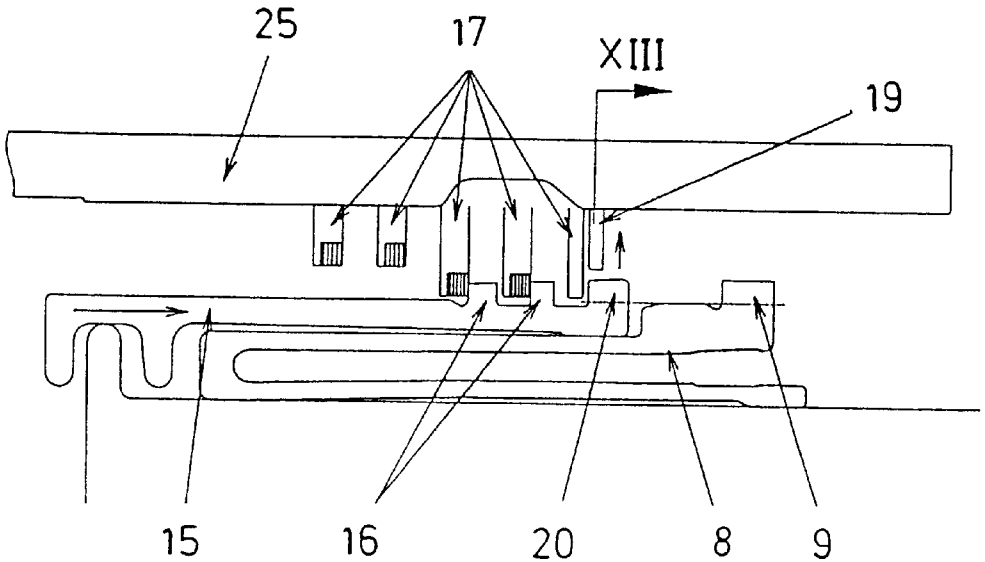
Figure 13C:
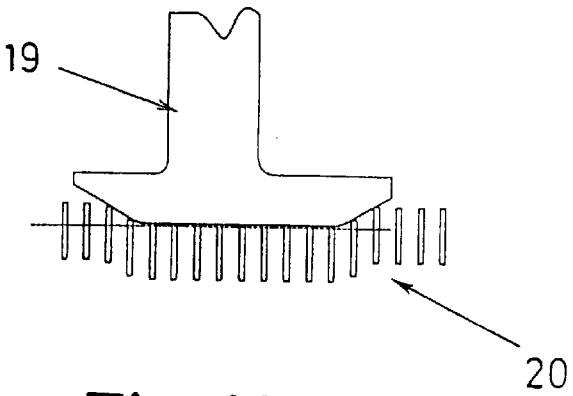
Figure 13C:
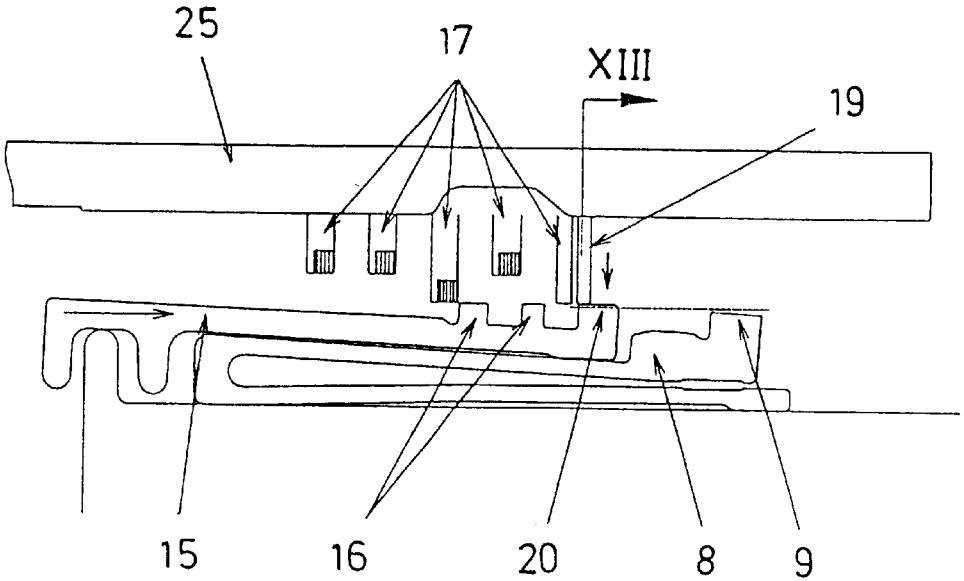

FIGS. 13A.1, 13B.1 and 13C.1 are respective details along the corresponding sections XIII indicated in FIGS. 13A, 13B and 13C.

FIG. 13A.2 is a partial detail according to the view E indicated in FIG. 13A.

Figure 1:
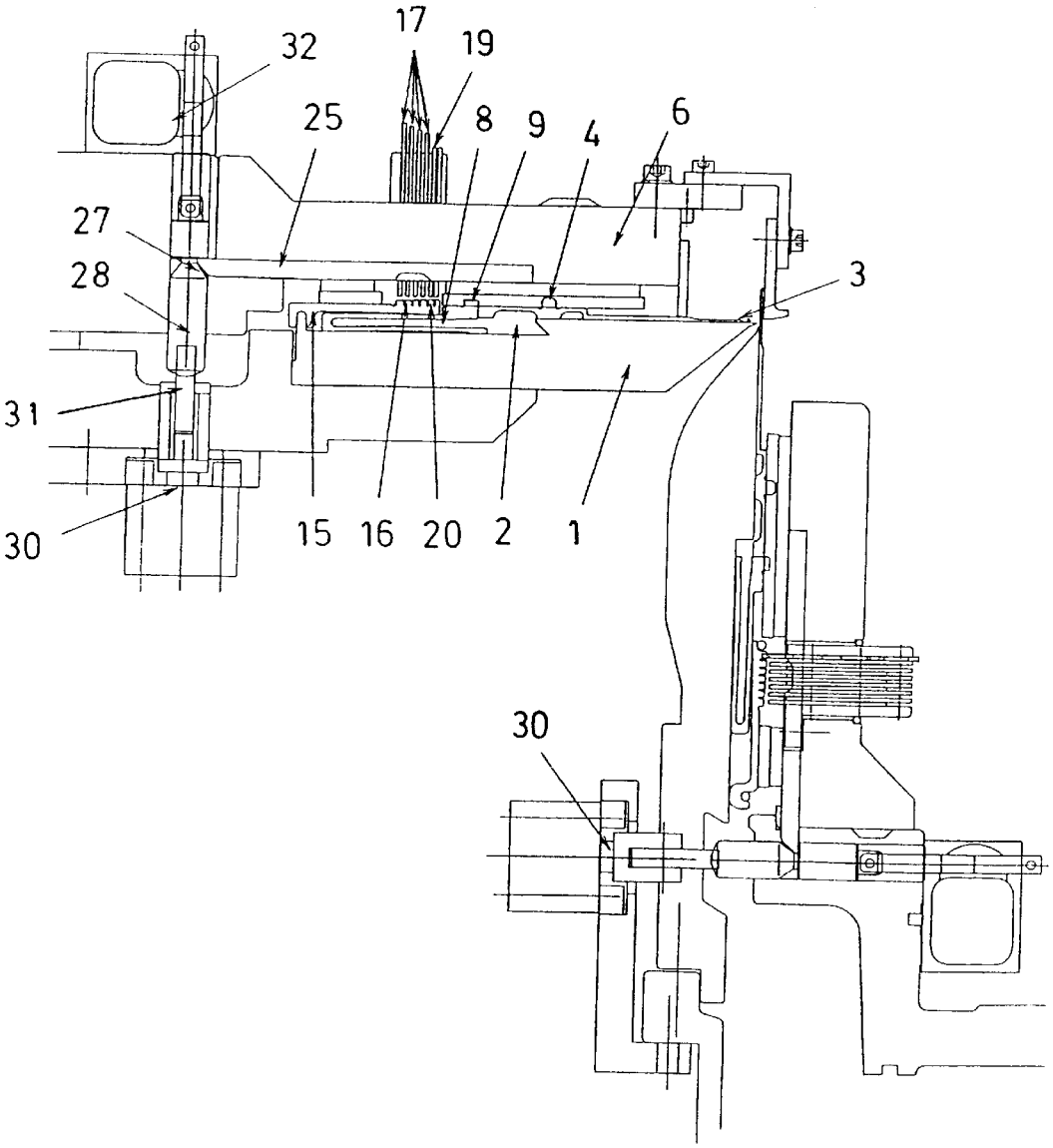
FIG. 1 shows a section of a machine with the devices which are the subject of the present invention.

FIG. 1 shows a general view of a circular knitting machine, to which the present invention has been applied in the dial positions (6), as in the body positions. In order to avoid unnecessary complication of the description, it is limited to the dial system, the possibility of likewise applying it to the body being obvious.

The present invention can be applied to a circular knitting machine of the type which has a needle bed (1) (in this example it is a needle dial) which has the corresponding tricks (2) in which the needles (3) are accommodated.

Figure 2:
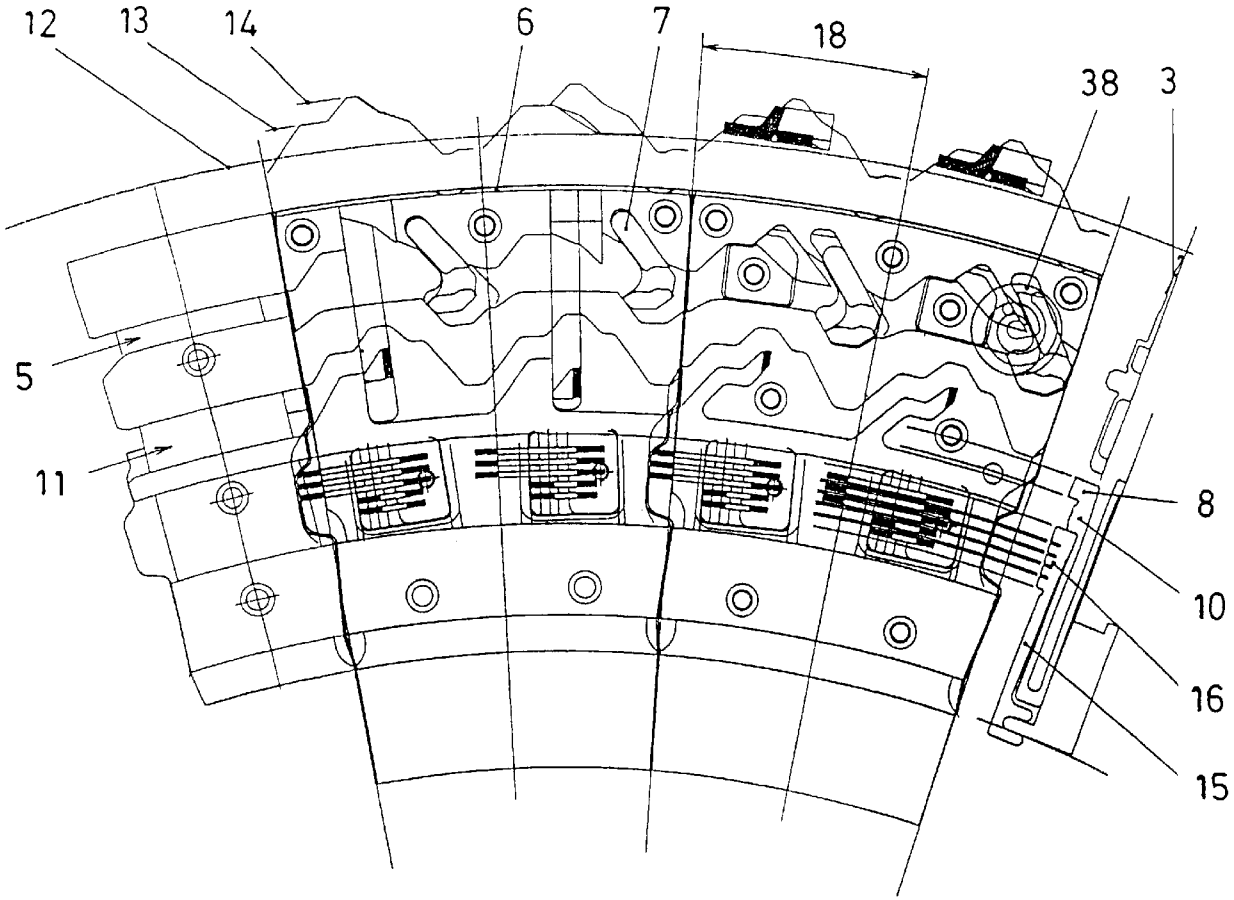
FIG. 2 shows a plan view of the dial section and the jacks and needles of the machine.
Figure 3A:
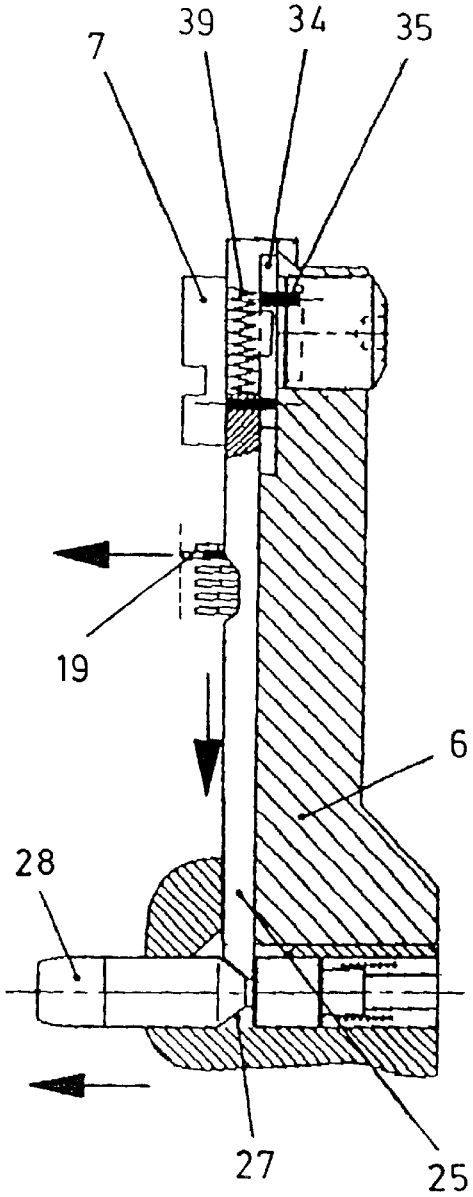
FIGS. 3A and 3B show the internal portion of the knitting position, with the mechanisms of canceling the knitting position and the stitch cam, in a respective lateral section and front view.
Figure 3B:
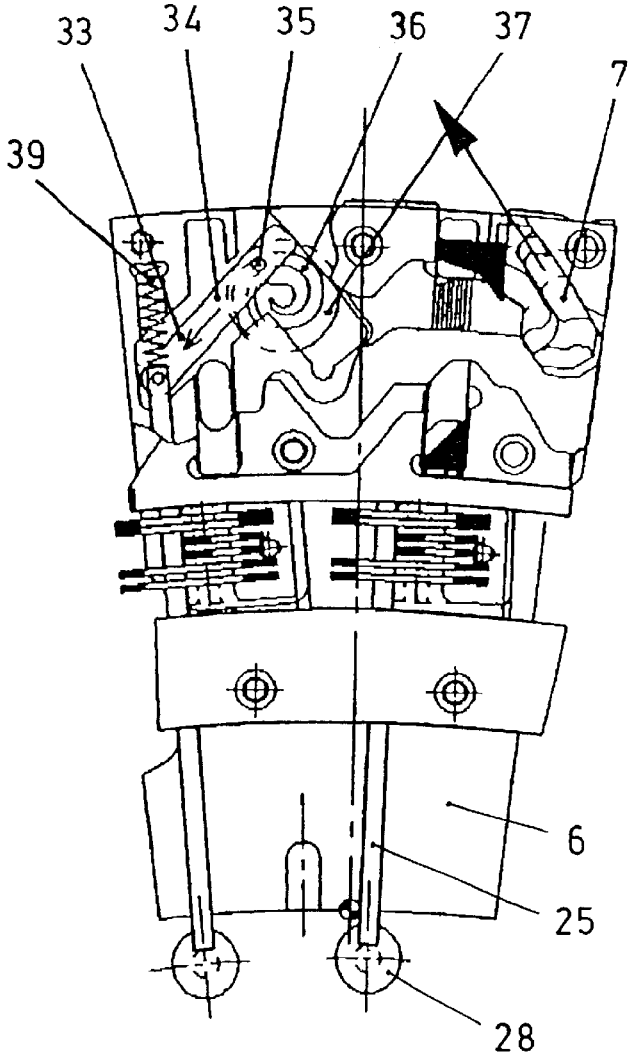

The said needles (3) have an active butt (4), with a first cam track (5) (indicated by an arrow in FIG. 2) of the cam sections (6), the said track (5) being capable of causing the retraction of the said needles (3) from the more advanced, clearing, position (14) to the stitch forming positions in the zone of the stitch cam (7) which corresponds to the retracted or cancellation (12) position of the needle (3), as can be seen in FIG. 2.

A first jack (8) (see FIGS. 1 and 2) is located within the tricks (2) of the needle bed (1) and is related to each needle (3), and has a retractable butt (9) which can adopt two positions. In a first position (10), which we will call active, the butt (9) is located outside the trick (2) of the needle bed and in the said position said butt, and consequently the jack (8), is moved by the action of a second cam track (11) capable of pushing on the jack (8) and indirectly on the corresponding needle (3) from the cancellation position (12) to the loop position (13) or the clearing position (14).

In this type of machine, there is a second jack (15) related to this jack (8) and having various selectable butts (16), disposed in order to be actuated by means of the corresponding selectors (17) arranged in each knitting position (18) so that the said selectors (17) take the form of a cam and can or cannot cause, according to their location, the descent of the butt (9) of the first jack (8) and consequently select the needle (3) so that it is kept in its cancellation position (12) or rises to the loop position (13) or clearing position (14), according to the moment when the descent of the said butt (9) occurs. All of the above is according to a known technical arrangement for needle selection which is prior art of the present invention, and has been described solely to define the type of machine to which the invention can be applied.

Figure 4A:
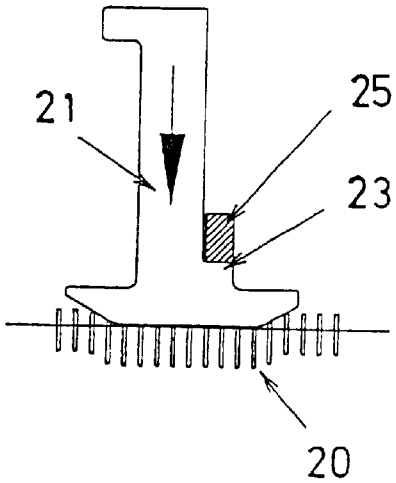
FIG. 4A is a detail along the section IV indicated in the previous Figure.
Figure 4:
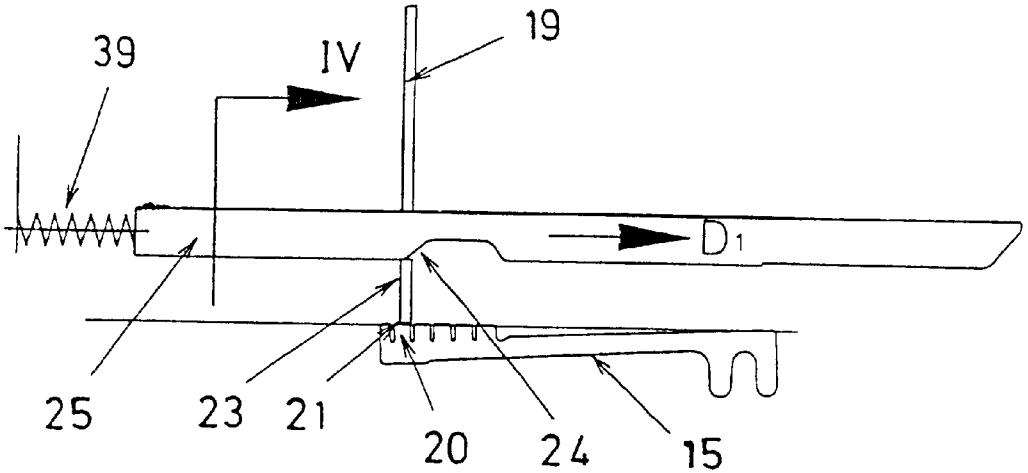
FIG. 4 shows the automatic cancellation selector in its active position, as well as its action on the butts of the jack.
Figure 5A:
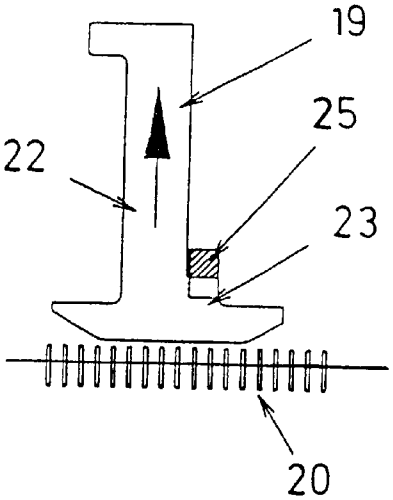
FIG. 5A is a detail along section V indicated in the previous Figure.
Figure 5:
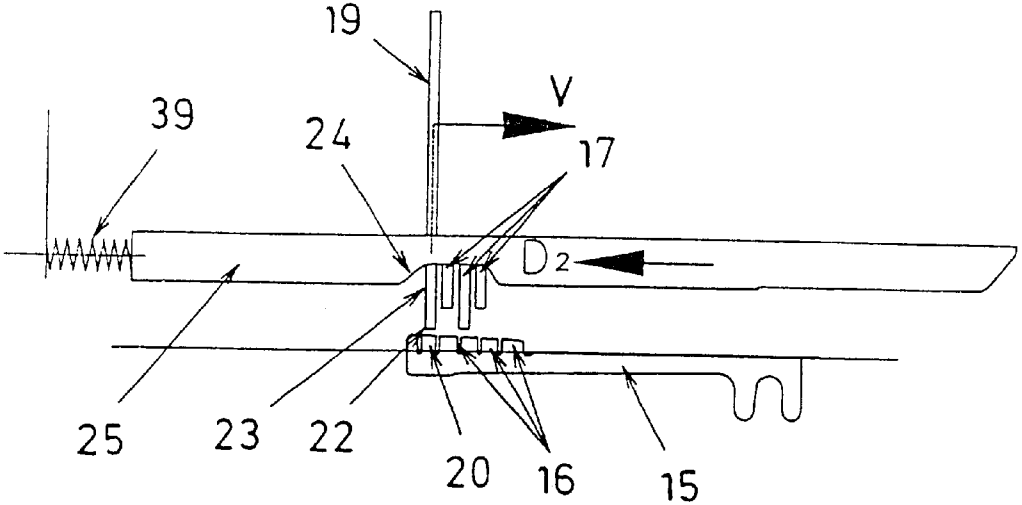
FIG. 5 shows the automatic cancellation selector in its retracted position.

The object of the present invention is described hereinbelow, and consists of an automatic needle selection device which permits the cancellation of the needle selection in the desired knitting positions in accordance with a program and in machines which have a selection system of the kind described in the preceding paragraphs, in which at least one of the selectors (17) (mentioned above) of each knitting position is an automatic cancellation selector (19) (see FIGS. 1, 2, 3, 4 and 5), which can by automatic means adopt an active position (see FIG. 4) with the automatic selection butts (20) of the second jack (15), which in its turn causes the descent of the butts (9) of the first jacks (8). In general, each second jack (15) has a corresponding automatic selection butt (20), but the object of the present invention would not change regardless of jacks (15) having no automatic selection butt (20) being arranged in any zone of the machine for specific requirements, for example, for the change zone of automatic selection or else of the stripers which deliver the yarn.

The cancellation of the selection of the needles (3) is effected upon the said actuation of the automatic selector (19), independently of the programming arranged in the rest of the selectors (17), thus permitting the cancellation of given knitting positions in the arrangements which are of interest, and consequently bringing about plural variants in the fabrics which the machine can produce.

On the other hand, the said automatic cancellation selector (19) can adopt a second, retracted position (22) (see FIG. 5) which leaves inactive the said selector (19) with the automatic selection butts (20) of the second jack (15), which permits the remainder of the selectors (17) to select their corresponding selection butts (16), and consequently the needles (3) knit the stitch corresponding to what is programmed in the said manual selectors (17).

It is of course possible, starting from the object of the invention described in these last paragraphs, to develop various solutions which do not limit or modify the concept, and which are set forth hereinbelow.

Figure 6:
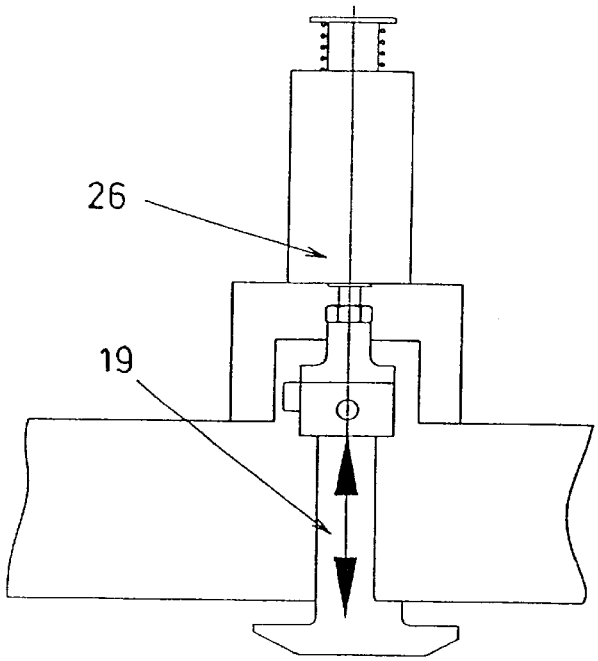
FIG. 6 shows an automatic device for control of the automatic cancellation selector.

In order to locate the automatic cancellation selector (19) in the first, active position (21) or in the second, retracted position (22), a drive element such as a pneumatic cylinder or an electromagnet (26) can be used, as shown in FIG. 6.

In another embodiment, it is possible to bring about the positioning of the selector (19) by arranging in this an active butt (23) facing the action of a first cam (24) arranged on a first slide (25) (see FIGS. 4 and 5) and capable of adopting two positions. The active position (21) of the selector (19) is obtained by means of the action of the first cam (24) of the slide (25) on the lug (23) of the selector (19) when the slide (25) is displaced in the direction D1 (see FIG. 4) and, as has been stated hereinabove, it produces the cancellation of the selection programming of the needles (3) which is provided by means of the manual selectors (17).

On the other hand, the slide (25) can be displaced in the direction D2 (see FIG. 5) so that the first cam (24) is allowed to become active on the lug (23) of the automatic cancellation selector (19), permitting this to go back to its retracted position (22), the said selector (19) facing the automatic selection butts (20) of the second jacks (15) consequently remaining inactive, and consequently these jacks (15) and the associated needles (3) remaining selected according to what has been programmed manually on the manual selectors (17).

Figure 7:
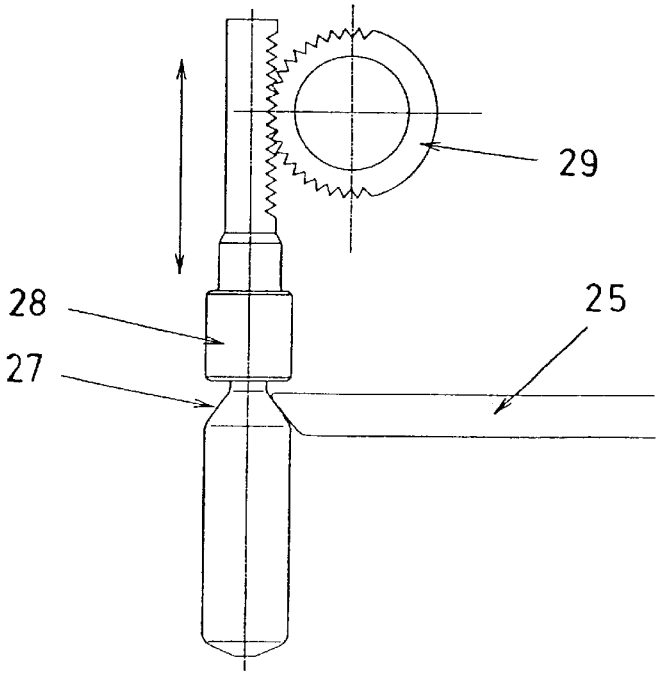
FIG. 7 shows an automatic device for control of the second slide.

Various devices can be used in order to cause the displacement of the first slide (25), among which, without limitative character, one is set out (see FIG. 7) which is formed by a second cam (27) with two levels and disposed in a second slide (28) which can assume either of two positions, one of which produces the displacement D2 of the slide (25) (see FIG. 5), and the other of which allows the said slide to move back in the direction D1 (see FIG. 4), pushed by the action of a spring (39).

The programmed displacements D1 and D2 of the second slide (28) can be brought about by the action of a suitably controlled motive element (29) (see FIG. 7), or else the said displacements D1 and D2 can be produced by the action of an inclined cam (31) disposed on a rotary control (30) (see FIGS. 1 and 8) which slides (as shown by the arrow) perpendicularly of the axis of the second slides (28), such that the said cam (31) can be active (see FIG. 8) or inactive (see FIG. 9) in relation to the said slide (28), according to a set program.

Figure 10A:
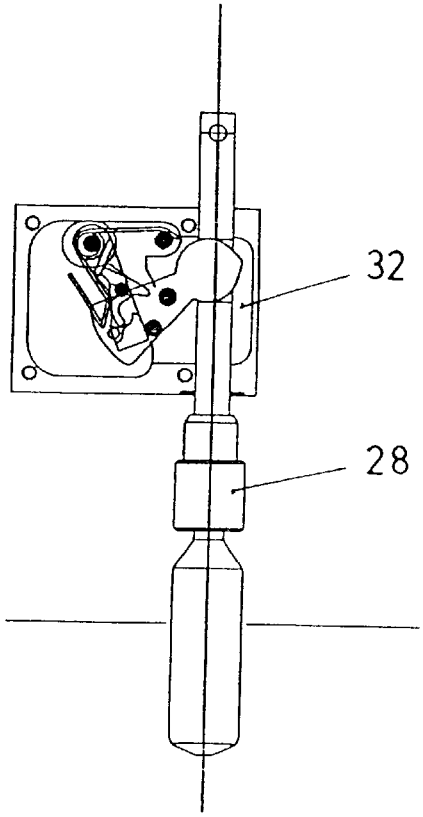
FIGS. 10A and 10B show an example of a retaining mechanism with mechanical memory, in two positions.
Figure 10B:
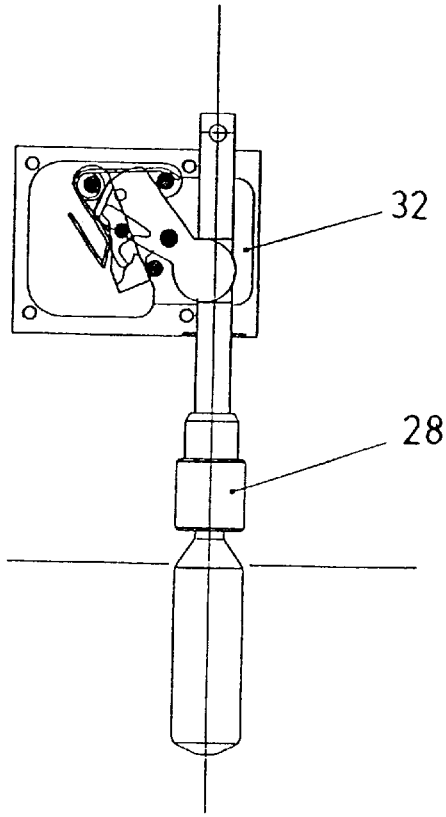

In order to be able to keep the slide (28) in each of its two positions, a retaining element with memory (32) can be arranged. An example of a retaining mechanism with memory (32) is shown in FIG. 10, and is not described in detail as it is known; it is obvious that any other mechanism with a similar function can be applied.

By means of the combination of the retaining mechanism (32), the rotary control (30) (being in the position shown in FIG. 8), and the slide (28), the latter changes from position D1 to D2, or vice versa, from D2 to D1. On the contrary, if the cam (31) of the rotary control (30) is in its inactive position (see FIG. 9), it goes past without acting on the slide (28) and the latter maintains its position D1 or D2 in which it was situated before the control (30) going past.

This rotary control (30) goes past each of the slides (28) of the machine (in general one for each knitting position) and the rotary cam (31) will change its position in each knitting position according to what has been programmed in a controller.

As mentioned hereinbefore, the position D1 or D2 which the second slide (28) adopts, keeps implicit the position occupied by the slide (25) and in its turn that of the automatic cancellation selector (19), and consequently the cancellation of the programmed needle selection is governed according to the manual selectors (17) or it is permitted that these govern the movement of the needles.

To attain the adequate cancellation of a knitting position it is necessary to ensure, as well as preventing the needles working in it, that the stitch cams (7) move back and do not force the movement of the needles (3), which would lead to a deformation of the fabric produced and consequently poor quality of the same.

Figure 11B:
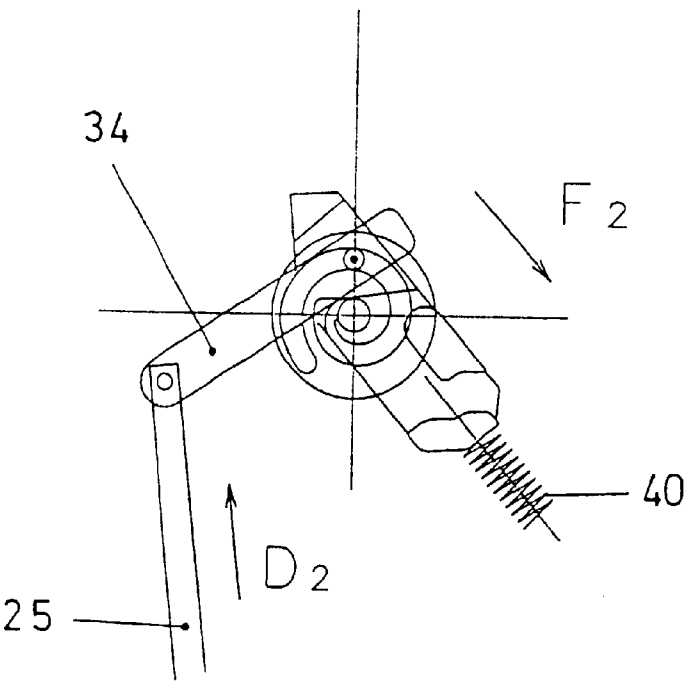
FIGS. 11A and 11B show a detail of the cancellation control system for the stitch cam, in two positions.
Figure 11A:
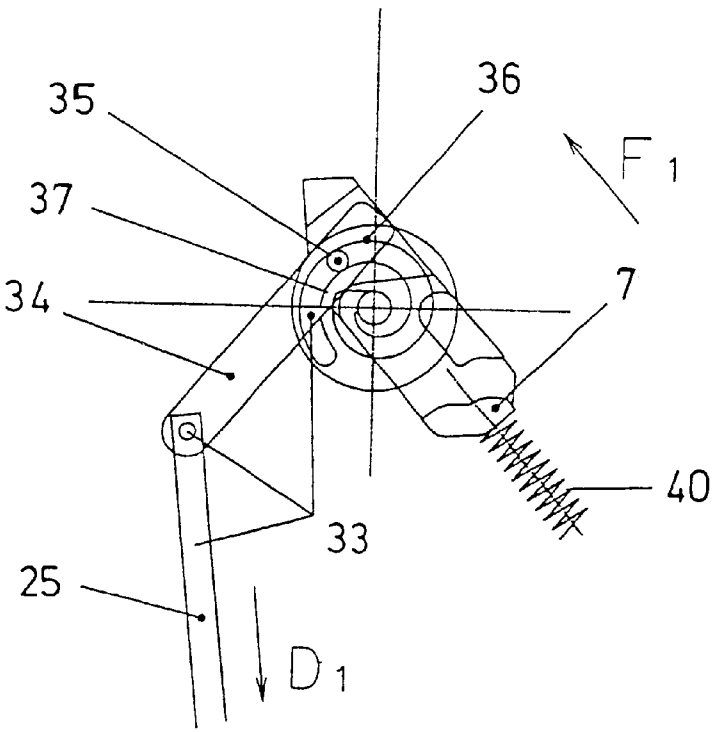

With the device of the invention, the drawing back of the position of the stitch cams (7) to the inactive position facing the butts (4) of the needles (3) is effected by means of a mechanical transmission (33) (see FIGS. 11A and 11B) which relates the position of the stitch cam (7) to the position of the first slide (25) and is capable of permitting the stitch cam (7) to move back in the path of the arrow F1, the cancellation selector (19) always being situated in the needle cancellation position (see FIG. 4), and the slide (25) being displaced in the path of the arrow D1 (FIG. 11A). In the contrary case, the transmission (33) pushes the stitch cam (7)

in the path of the arrow F2 (FIG. 11B) and obliges it to occupy the position programmed in the stitch gradation adjuster, which in this embodiment is an archimedean spiral (37).

An embodiment of the mechanical transmission (33) between the slide (25) and the stitch cam (7), according to FIGS. 11A and 11B, consists of a lever jointed to the slide (25) and having an active lug (35) with a surface (36) which is capable of pushing on the lever (34) such that the latter pushes the stitch cam (7) (see FIG. 11B) toward its active position, according to the arrow F2, or releases it and permits it to move back, according to the arrow F1 (see FIG. 11A), due to the action of a second stitch cam spring (40).

In the embodiment shown, the surface of the archimedean spiral (37) is used, so that it works, via the lug (35) of the lever (34), as a pushing surface (36).

Figure 12:
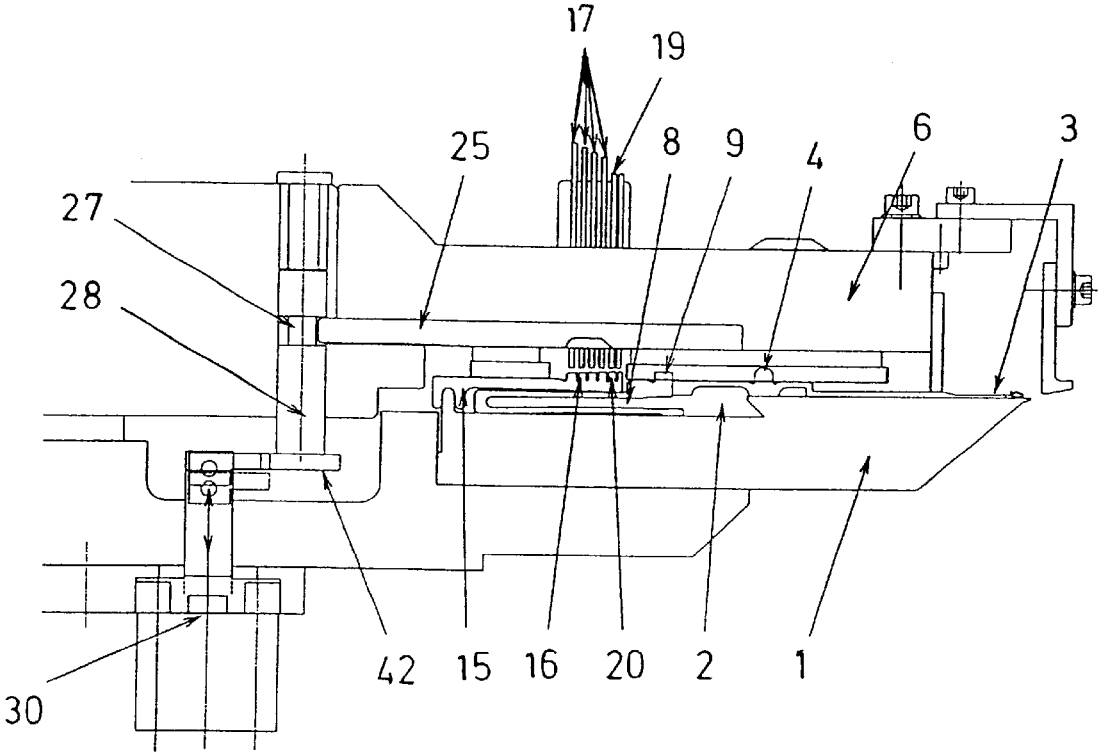
FIG. 12 shows a diagram of a second embodiment of cams and rotary control.

A second embodiment for the control and positioning of the slides (25) of the cam sections (6) of the machine is shown in FIG. 12.

In this embodiment the slide is positioned by means of a rotary cam (27) which has two levels and, if it passes from its low level to its high level, can push the slide (25), or else, if it passes from its high level to its low level, can allow the said slide to move back.

Figure 12A:
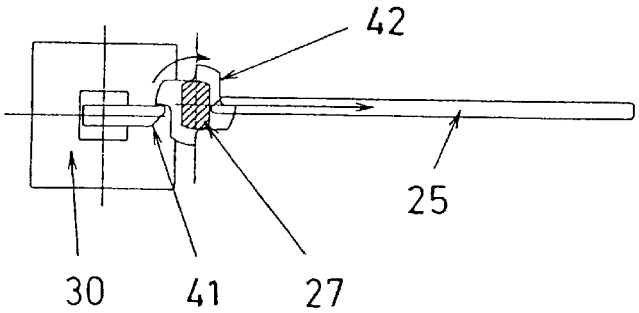
FIG. 12A is a partial detail in plan of the preceding Figure.

In this embodiment, a rotary control (30) is arranged, which has a rocking cam (41) (FIG. 12A) which can adopt two positions, an active one with a toothed wheel (42) which rotates integrally with the cam (27), and the other, inactive one, on the said wheel (42).

Figure 8:
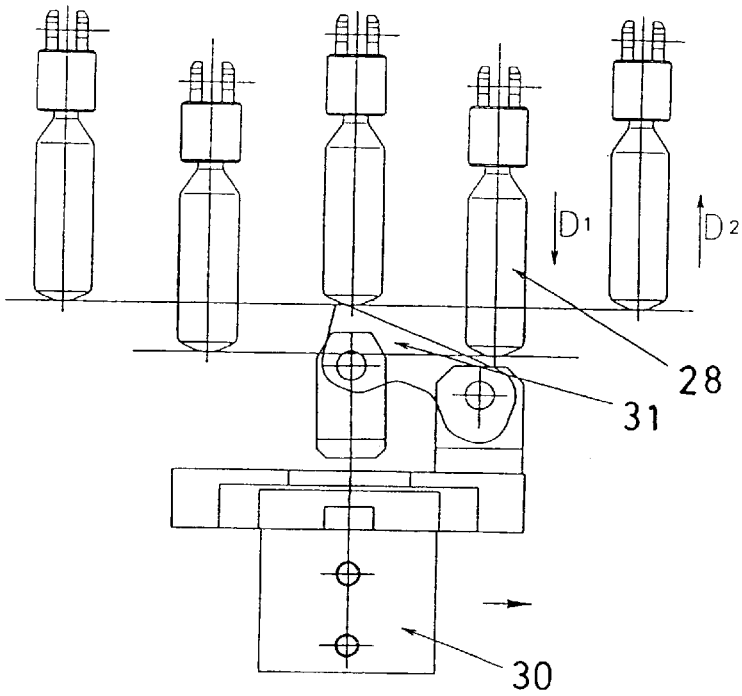
FIGS. 8 and 9 show the action of the cam of a rotary control on the second slides.
Figure 9:
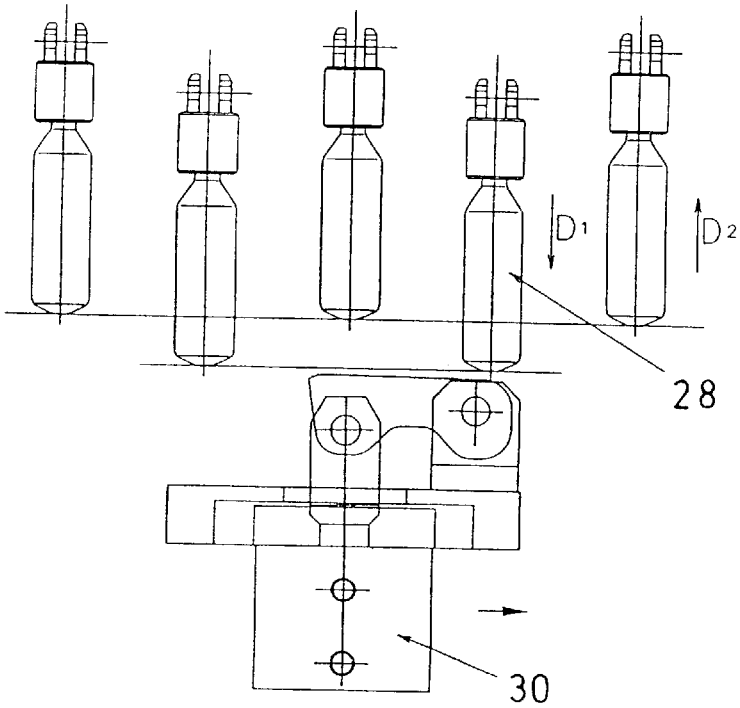

As can be seen, the same object is attained with this arrangement as was attained with the embodiment shown in FIGS. 1, 8 and 9 and that it is to displace the slide (25) in each knitting position (6) in a selective manner, according to a program of a controller, in order to bring about the cancellation of the desired machine positions.

An embodiment is shown in FIG. 13 which shows a variant of the embodiment of FIGS. 1 or 12, in which variant there is used as the second jack (15) a type of jack with selection by displacement instead of selection by rotation as in the jacks (15) of the above-cited Figures, without modifying the object of the present invention. In the embodiment of FIGS. 13, the jack (15) has diverse selection butts (16), which cause a small axial displacement of the jack (15) such that the butt (20) is or is not facing the corresponding selector (20), thus producing or not producing the descent of the butt (9) of the jack (8) and consequently the selection of the needle (3).

Moreover, at least one automatic cancellation selector (19) is arranged in each knitting position, and can be situated in an active position (see FIG. 13C) or an inactive position (see FIGS. 13A and 13B) facing the automatic selection butts (20) of the jack (15), and can cause the cancellation of knitting of all the needles or, on the contrary, permit the machine to knit in the position (18) according to what is programmed in the manual selectors (17), in the same manner as in the embodiment of FIGS. 1 or 12.

Another variant of the embodiment of FIG. 1 consists of arranging the manual selectors (17) aligned corresponding to the selection of the loaded loops and subsequently to the manual selectors (17) corresponding to the cancellation of the needles, with which the same selections can be effected as in the embodiment of FIG. 1, but with the selection jacks (15), which would be disposed at the half of the butts (16).

It is obvious that the manual selection butts (16) of the jack (15) can be disposed in many different ways according to the type of stitch which it is desired to obtain on the machine; thus, if they are disposed alternately, the resulting fabric is of the interlock type or else 1×1 dispositions; on the other hand, if butts are disposed in a double sequence, for example, two butts (16) of the jacks (15) of two contiguous needles, and the two following jacks (15) without butts (16), the result is the production of 2×2 fabrics, so that the different sequences are not a limiting factor for the object of the invention.

Also, it is obvious that it is possible to dispose any intermediate jack between the first jack (8) and the second jack (15) without modifying the object of the patent, whenever the described operations for attaining the selection and the cancellation of knitting by the needles are effected by the assembly of jacks, by the descent of the butt (9) of the jack (8) at the appropriate time, in a programmed or else automated manner.

An infinity of variants can of course be developed without changing the object of the patent, with which there is obtained in a simple manner a circular machine for the manufacture of knitted fabrics, permitting canceling the operation of the different positions of the machine according to a set program, moreover obtaining the cancellation of the action on the needles of the stitch cams of the cancelled positions, so that very varied fabrics of high quality can be obtained.

It is obvious, it has not been mentioned that a mechanism which cuts and fastens the yarn in each of the cancelled positions and is capable of feeding a new yarn in each position which passes from cancellation to knitting; this can be realized by means of a striper mechanism, which is not the object of this patent, but which is indispensable for the operation of the machine.

What is claimed is:

1. Automatic device for selection of needles in a circular knitting machine having at least one needle bed with corresponding tricks arranged to accommodate needles and having at least one butt active with a first cam track of a cam section and capable of causing retraction of the needles to a stitch cam position, each of the needles being related to a first jack having a retractable butt that in an active position is moved by a second cam track that pushes said first jack thereby shifting the needle from a cancellation position to a loop position or a clearing position, and at least one second jack related to the first jack having selectable butts whereby manual selectors arranged in each knitting position cause movement of the retractable butt of the first jack and consequently select the needle so that said needle is kept in the cancellation position or cause movement of said needle to the loop position or to the clearing position, wherein said automatic needle selection device comprises an automatic cancellation selector which is movable between a first, active position and a second, retracted position;

an automatic selection butt on the second jack that when activated causes movement of all the butts of the first jack and results in the cancellation of the needles independently of a programming arranged in a remainder of the selectors such as to permit the remainder of the selectors to select their corresponding selection butts whereby the needles knit according to the programming of the manual selectors.

2. Automatic device for selection of needles in a circular knitting machine according to claim 1, wherein the automatic cancellation selector is governed by a pneumatic cylinder or electromagnet.

3. Automatic device for selection of needles in a circular knitting machine according to claim 1, wherein the automatic cancellation selector has a butt active with a first cam arranged on a first slide having two positions, a first position in which said first cam pushes the automatic cancellation selector to an active position and a second position which allows the automatic cancellation selector to move back to a retracted, inactive position.

4. Automatic device for selection of needles in a circular knitting machine according to claim 3, wherein an automatic movement of the first slide is obtained by the action of a motive element.

5. Automatic device for selection of needles in a circular knitting machine according to claim 3, wherein an automatic movement of the first slide is obtained by a second cam having two levels corresponding to two positions, a first position which results in the advance of the first slide and a second position which allows the first slide to move back.

6. Automatic device for selection of needles in a circular knitting machine according to claim 5, wherein the second cam is arranged on a second slide.

7. Automatic device for selection of needles in a circular knitting machine according to claim 6, wherein a movement of the second slide is produced by a programmed action of a motive element.

8. Automatic device for selection of needles in a circular knitting machine according to claim 6, wherein the movement of the second slide is produced by an inclined cam of a rotary control that slides perpendicularly to an axis of the second slide so that said inclined cam is active or inactive in relation to the second slide according to a pre-set program.

9. Automatic device for selection of needles in a circular knitting machine according to claim 8, wherein the second slide is associated with a retaining element having a memory that maintains said second slide in one of two positions, and changes said second slide from one position to the other position each time the inclined cam of the rotary control acts on the second slide.

10. Automatic device for selection of needles in a circular knitting machine according to claim 5, wherein the second cam is arranged on a rotary shaft united to a toothed wheel selectively rotated by a rocking lever of a rotary control.

11. Automatic device for selection of needles in a circular knitting machine according to claim 3, wherein a mechanical transmission between the first slide and a stitch cam can move the stitch cam to an inactive position facing the butts of the needles whenever the automatic cancellation selector is in a cancellation position, and can release said stitch cam to a programmed position whenever said automatic cancellation selector is not in the cancellation position.

12. Automatic device for selection of needles in a circular knitting machine according to claim 11, wherein the mechanical transmission between the first slide and the stitch cam is comprised of a lever articulated to said first slide and having a lug with a surface that can push the lever so as to draw the stitch cam to the inactive position.

13. Automatic device for selection of needles in a circular knitting machine according to claim 12, wherein the surface of the lug that pushes the lever coincides with an archimedean spiral of stitch gradation.

14. Automatic device for selection of needles in a circular knitting machine according to claim 4, wherein the motive element comprises an electromagnet.

15. Automatic device for selection of needles in a circular knitting machine according to claim 4, wherein the motive element comprises a pneumatic cylinder.

16. Automatic device for selection of needles in a circular knitting machine according to claim 7, wherein the motive element comprises an electromagnet.

17. Automatic device for selection of needles in a circular knitting machine according to claim 7, wherein the motive element comprises a pneumatic cylinder.

* * * * *